US005765269A

United States Patent [19]

Zarth

[11] Patent Number: 5,765,269

[45] Date of Patent: Jun. 16, 1998

[54] COLUMBARIUM

[76] Inventor: Rudolf Zarth, Mainzer Strasse 41, D-66121 Saarbrücken, Germany

[21] Appl. No.: 824,059

[22] Filed: Mar. 24, 1997

Related U.S. Application Data

[63] Continuation of Ser. No. 509,030, Jul. 28, 1995, abandoned.

[30] Foreign Application Priority Data

Aug. 4, 1994 [DE] Germany ..... 44 27 611.7

[51] Int. Cl.[6] ..... A61G 19/00

[52] U.S. Cl. ..... 27/26; 52/134; 52/136

[58] Field of Search ..... 27/26, 28; 52/128, 52/133–134, 136–139

[56] References Cited

U.S. PATENT DOCUMENTS

| | | | |
|---|---|---|---|
| 964,184 | 7/1910 | Pugh | 52/136 |
| 980,750 | 1/1911 | Blyth | 52/136 |
| 1,203,535 | 10/1916 | Graham | 52/134 |
| 2,235,185 | 3/1941 | Wiley | 52/136 |
| 2,513,951 | 7/1950 | McClellen . | |
| 3,925,944 | 12/1975 | Pickel | 52/133 X |
| 3,990,198 | 11/1976 | Ortutay | 52/136 |
| 4,023,316 | 5/1977 | Martin | 52/137 X |
| 5,287,603 | 2/1994 | Schorman | 27/1 |

FOREIGN PATENT DOCUMENTS

| | | | |
|---|---|---|---|
| 2361922 | 6/1975 | Germany . | |
| 2517805 | 11/1975 | Germany . | |
| 296978 | 12/1990 | Japan | 52/136 |
| 92978 | 11/1983 | United Kingdom | 52/128 |

*Primary Examiner*—Carl D. Friedman
*Assistant Examiner*—Beth A. Aubrey
*Attorney, Agent, or Firm*—Friedrich Kueffner

[57] ABSTRACT

A columbarium in the form of a structure includes a plurality of components forming urn chambers for receiving at least one urn. The front opening of each component is closed by a door. The components are arranged in horizontal rows with the side walls of the components being located next to one another. At least two rows of components are arranged on top of each other, wherein an upper of the two rows is rearwardly offset relative to the lower of the two rows so as to form a step. The structure may be pyramid-shaped with four corners, wherein the rows are arranged in a square configuration on a plurality of levels.

10 Claims, 3 Drawing Sheets

COLUMBARIUM

This is a continuation of application Ser. No. 08/509,030 filed Jul. 28, 1995 now abandoned.

BACKGROUND OF THE INVENTION

1. Field of the Invention

The invention relates to a columbarium in the form of a structure having rows of urn chambers arranged next to one another, wherein the rows are arranged one above the other.

2. Description of the Related Art

Such columbaria are known from other cultures, for example, in the form of high urn walls with projecting passages which are arranged one above the other.

In the Western European area, urns are essentially placed in the manner of coffins in earth burial places. As a rule, there is room for four urns in horizontal rows one behind the other.

The lack of space in cemeteries leads to the desire to produce grave sites which are as compact as possible and also extend in vertical direction. However, there are limitations to carrying out this desire because of sensitivities resulting from the tradition of the earth grave.

SUMMARY OF THE INVENTION

It is the object of the invention to provide a columbarium which is as compact as possible, while still resembling as much as possible a free earth grave.

In accordance with the invention, this object is met, starting from a columbarium of the above-mentioned type, by a structure which is provided with steps.

The fact that the columbarium is a structure becomes less significant. In the case of a suitable configuration of the structure, preferably in the total shape of a pyramid, there is a parallel to the earth mound of a prehistorical barrow. The visited grave is not visible in a structure with passages thereabove. The grave is exposed.

Preferably, always only one row of the urn chambers forms a step, wherein the step has a height of approximately 35–45 cm.

Consequently, even though a plurality of rows vertically one above the other would still be acceptable, not even a low structure wall is visible. Considering the circumstances, the highest possible degree of individuality exists.

In accordance with an advantageous further development of the invention, the structure is composed of concrete elements which each form an urn chamber.

A pyramid can be erected by merely placing such concrete elements one on top of the other. In the case of an offset arrangement, the length of each concrete element forming an urn chamber is predetermined by the fact that it is desired to have room for up to four urns one behind the other, as is the case in an earth grave.

Advantageously, except at the corners of the structure, the concrete elements have a downwardly open U-shaped cross section. At the corners themselves, the concrete elements have a configuration with open sides and the adjacent concrete elements have shorter sizes.

BRIEF DESCRIPTION OF THE DRAWINGS

In the drawings.

The drawings illustrate an embodiment of the invention.

DESCRIPTION OF THE PREFERRED EMBODIMENTS

Figure 1:
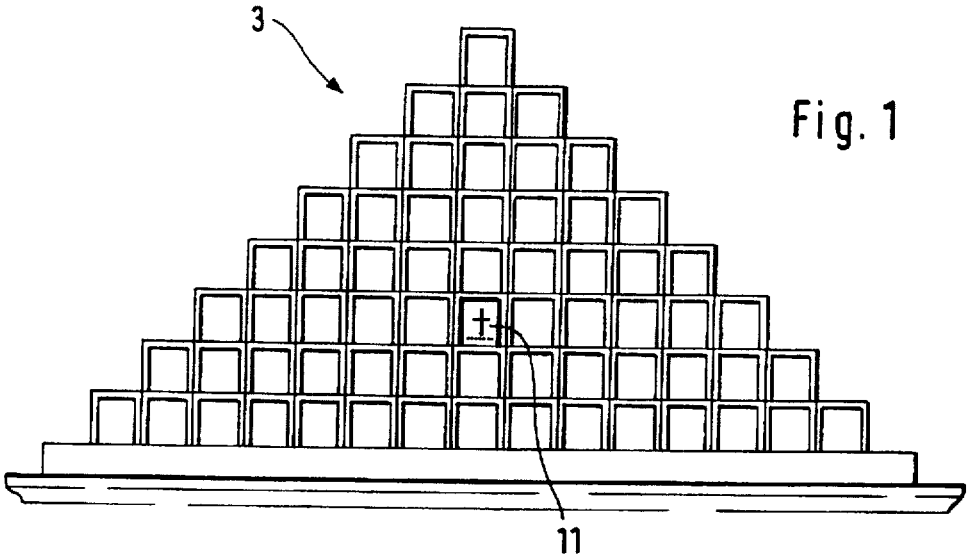
FIG. 1 shows a columbarium in an elevational view.
Figure 2:
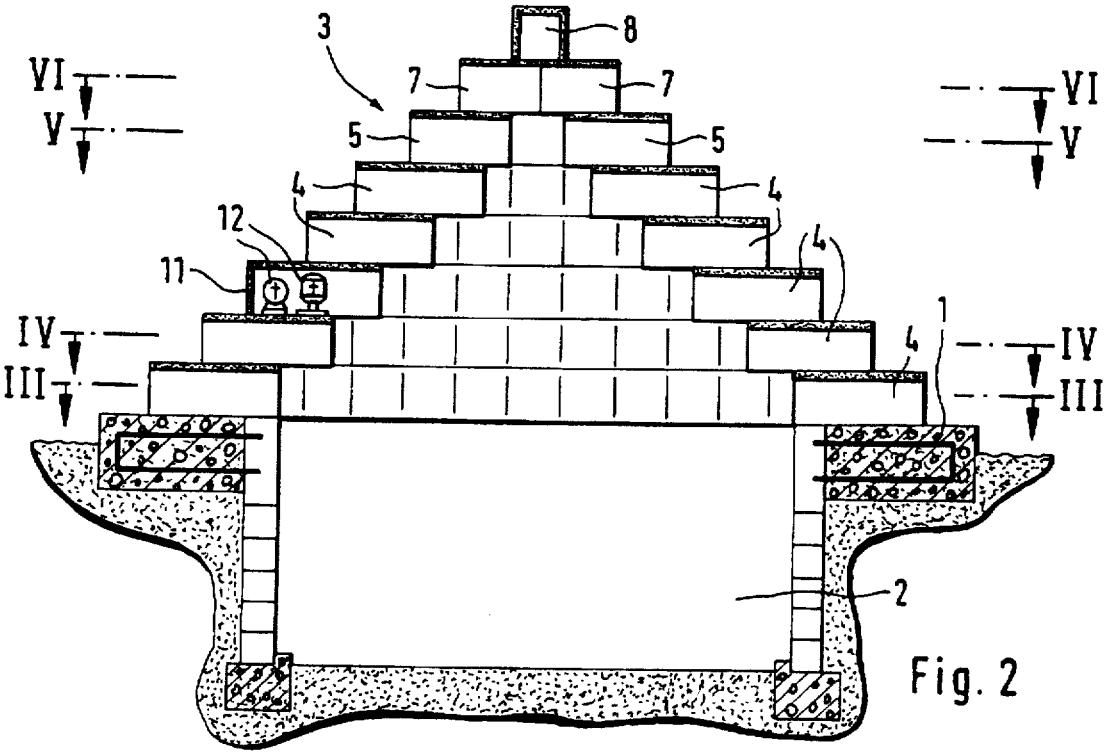
FIG. 2 shows the columbarium in a vertical center sectional view.

An annular, square concrete foundation 1 surrounds on the level of the soil surface the upper end of an earth chamber 2. The sides of the earth chamber 2 are provided with walls and the bottom of the earth chamber 2 is natural soil. The concrete foundation 1 projects slightly above the level of the earth surface.

A stepped pyramid 3 is erected in eight layers on the concrete foundation 1.

The pyramid 3 is composed of concrete elements 4–9 which form a kit. A variation 10 is illustrated at the top left of FIG. 3.

The concrete elements 4–7 have a U-shaped cross section. They are 40 cm wide and 40 cm high and have a wall thickness of 5 cm. Urns 12 are placed in the concrete elements.

The basic elements are the concrete elements 4 having a length of 100 cm, wherein the four side walls of the pyramid 3 are constructed of the concrete elements 4 to the extent possible. In the corner areas, the concrete elements 5 having a length of 80 cm and the concrete elements 6 having a length 40 cm are used. The concrete elements 7 having a length of 60 cm occur only in the layer which is the second to the top (FIG. 6).

The concrete element 8 is cube-shaped and has an open bottom side. The concrete element 8 again has an edge length of 40 cm and a wall thickness of 5 cm. This concrete element forms the uppermost layer.

The concrete elements 9 are cube-shaped and have an open bottom side and two adjacent open sides. The concrete elements 9 again have an edge length of 40 cm and a wall thickness of 5 cm. The concrete elements 9 are used entirely at the corners of the pyramid. Each variation 10 comprises concrete elements 5, 6 and 9, wherein the wall thickness is partially increased.

Figure 3:
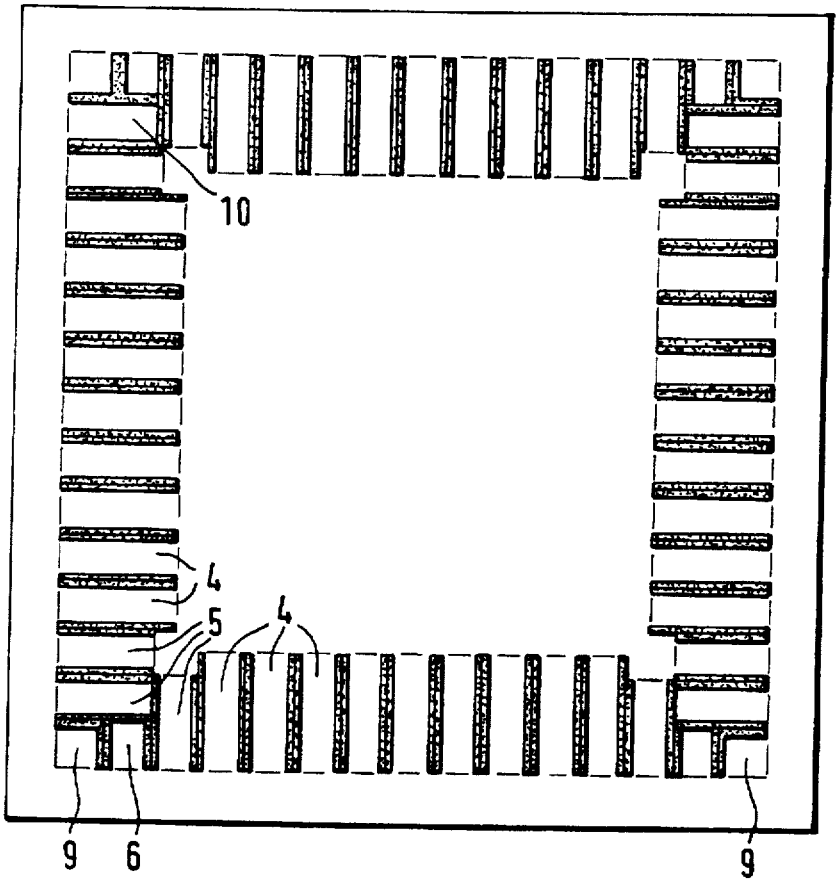
FIGS. 3–6 show the columbarium in horizontal sectional views taken along lines III—III, IV—IV, V—V and VI—VI, respectively, in FIG. 2.
Figure 4:
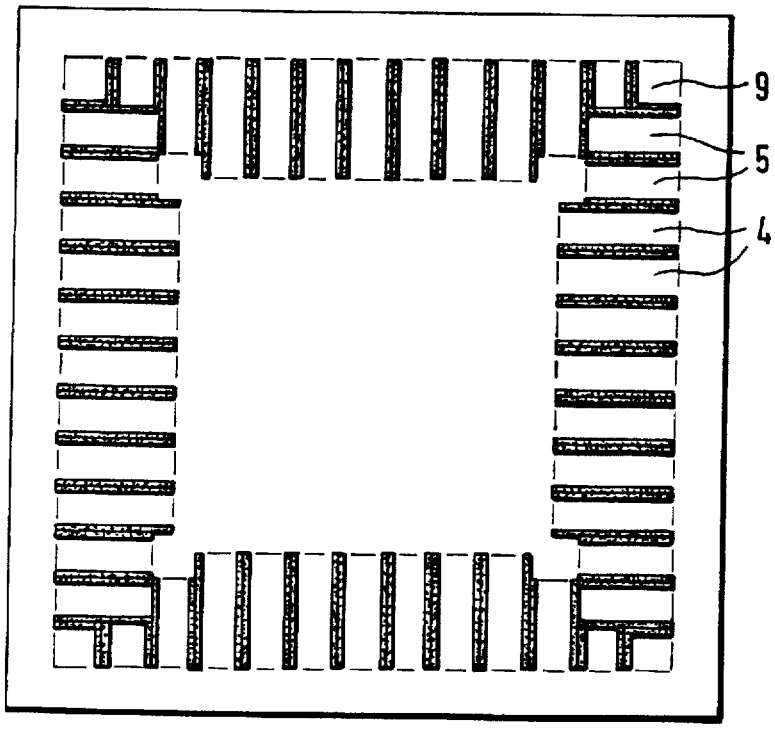
Figure 5:
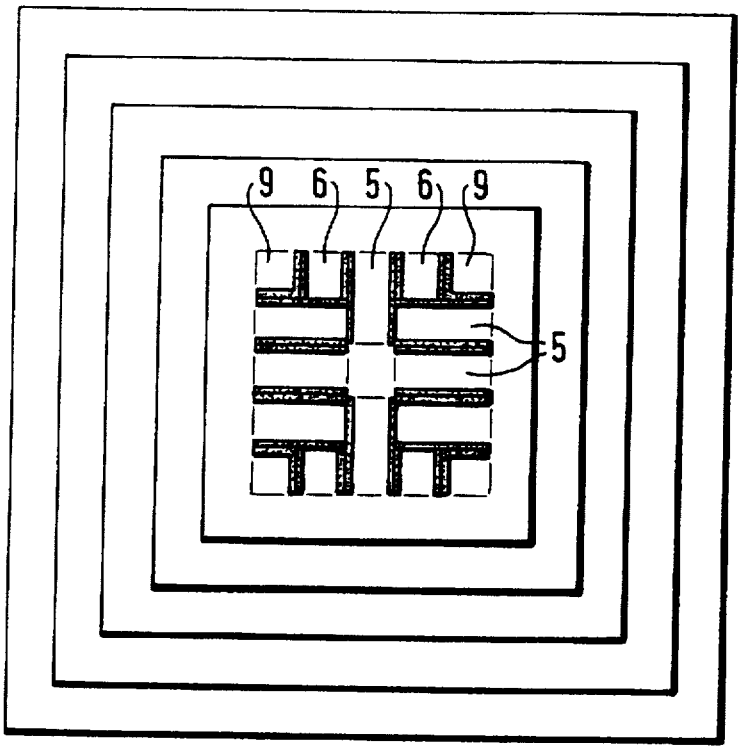
Figure 6:
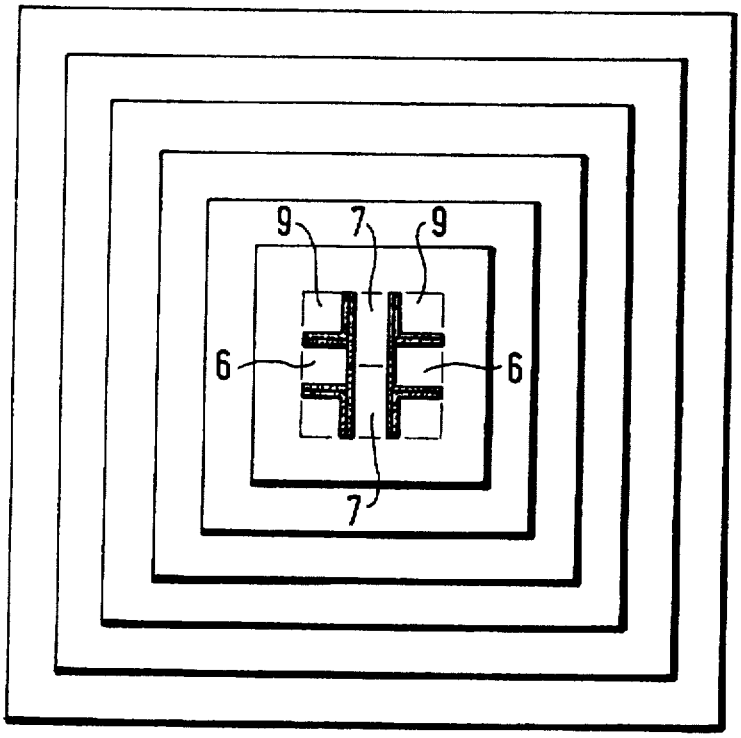

FIG. 3 shows the first layer of the concrete elements, FIG. 4 shows the second layer, FIG. 5 shows the sixth layer and FIG. 6 shows the seventh layer.

The concrete elements 4–6 are placed so that the open sides of the U-shaped cross sections are at the bottom, while the open sides of the concrete elements 9 face downwardly and outwardly. Arranged adjacent to the concrete elements 9 is on one side a concrete element 6 and on the other side a concrete element 5. Next arranged on both sides are once again concrete elements 5 which are followed by the concrete elements 4. In the sixth layer, no concrete element 4 is provided; see FIG. 5. The seventh layer has a special configuration, as can be seen in FIG. 6.

By reducing the number of concrete elements 4 by two from layer to layer, a step having a width of 40 cm is created in each case.

To the extent that they are not abutting each other in the corner areas, the urn chambers formed by the concrete elements 4–9, also the variation 10, are open toward the interior of the pyramid.

To the outside, the urn chambers are closed by heavy doors 11 which are inscribed and possibly decorated in the manner of grave stones.

The concrete elements are preferably composed of suitably dyed and/or decorative concrete.

Up to four urns can be placed in the urn chambers of the concrete elements 4 of the first layer. In the other layers, there is room for two urns each.

In the urn chambers which are open toward the interior of the pyramid, the urns can be pushed ahead until they fall out. As a result, they are transferred into the earth chamber 2 forming a common chamber.

I claim:

1. A columbarium in the form of a pyramid-shaped structure having an interior and four corners, the structure comprising a plurality of components forming urn chambers for receiving at least one urn, each component having a front opening, a rear opening and sides, the front opening of each component being closed by a door, the components being arranged in horizontal rows with the sides of the components being located next to one another, wherein the rows of components are arranged in a square configuration on a plurality of levels, wherein each row of components located on top of another row of components is offset toward the interior of the structure relative to the another row of components so as to form a step, further comprising additional concrete elements arranged at the corners of each level, the additional corner elements having a right parallelepiped overall shape with a square bottom surface.

2. The columbarium according to claim 1, wherein the step has a height of 35 to 45 cm.

3. The columbarium according to claim 2, wherein the step has a width, and wherein the width is equal to the height of the step.

4. The columbarium according to claim 1, wherein each component has a depth selected such that at least two urns can be placed in the component.

5. The columbarium according to claim 1, wherein each component is a concrete element.

6. The columbarium according to claim 5, wherein each concrete element has a downwardly open U-shaped cross-section.

7. The columbarium according to claim 1, wherein the additional concrete elements have a cube-shaped overall circumference.

8. The columbarium according to claim 1, wherein the pyramid has a top, a further concrete element being arranged at the top of the pyramid.

9. The columbarium according to claim 7, wherein each cube-shaped concrete element has two inwardly facing sides, another cube-shaped concrete element being arranged adjacent one inwardly facing side and a concrete element having the shape of two cubes being arranged next to another of the inwardly facing sides.

10. The columbarium according to claim 9, wherein two additional concrete elements having the shape of two cubes attached to each other are arranged adjacent the first concrete element having the shape of two cubes attached to each other and adjacent the two cube-shaped concrete elements.

* * * * *